US005797341A

United States Patent [19]

Hood

[11] Patent Number: 5,797,341

[45] Date of Patent: Aug. 25, 1998

[54] DEBRIS COLLECTION APPARATUS FOR USE DURING BOAT HULL CLEANING

[76] Inventor: William L. Hood, 9950 S. Ocean Dr. Suite #1603, Jensen Beach, Fla. 34957

[21] Appl. No.: 851,659

[22] Filed: May 6, 1997

[51] Int. Cl.[6] ..... B63B 59/00

[52] U.S. Cl. ..... 114/222

[58] Field of Search ..... 114/222, 343, 114/221 R; 15/1.7, 257.1

[56] References Cited

U.S. PATENT DOCUMENTS

| | | | |
|---|---|---|---|
| 3,205,851 | 9/1965 | Wiswell, Jr. | 114/222 |
| 4,026,233 | 5/1977 | Cox | 114/229 |
| 4,693,200 | 9/1987 | Noble | 114/47 |
| 4,838,195 | 6/1989 | Carter | 114/361 |
| 4,940,382 | 7/1990 | Castelain et al. | 114/222 |
| 5,152,242 | 10/1992 | Bradley | 114/222 |
| 5,211,125 | 5/1993 | Garland et al. | 114/222 |
| 5,465,676 | 11/1995 | Falcaro | 114/222 |

*Primary Examiner*—Stephen Avila
*Attorney, Agent, or Firm*—Henderson & Sturm

[57] ABSTRACT

A debris collection apparatus for use during the cleaning of boat hulls includes a debris collection tray for catching the debris as it is removed from the hull and a pair of wind screens to block the wind and prevent debris from being blown away from the area of the collection tray. Both the collection tray and the wind screens comprise adjustable tubular frames which suspend a flexible sheet within their periphery utilizing alligator type clips. The tubular frames are attached to the boat hull by either magnetic or suction attachment devices through flexible joint assemblies.

11 Claims, 4 Drawing Sheets

DEBRIS COLLECTION APPARATUS FOR USE DURING BOAT HULL CLEANING

BACKGROUND OF THE INVENTION

Field of the Invention

This invention relates to boats and other aquatic vehicles, and more particularly to an apparatus for collecting paint and other debris as it is removed from the hull or exterior surface of such a vehicle to prevent contamination of our lakes, oceans and waterways.

Description of the Related Art

U.S. Pat. No. 4,026,233 issued to Cox discloses a Protective Hull Safety Cover for marine vessels which is stated to have an auxiliary use to form an enclosure around a boat during cleaning of the hull, although such use is not further disclosed or described. Further, U.S. Pat. Nos. 4,693,200; 5,152,242;and 5,465,676 all disclose hull enclosure devices. While all of these patented constructions are adequate for the particular purpose and function for which they have been specifically designed, they are not at all suitable for fulfilling the role envisioned for the subject matter of the present invention.

BRIEF SUMMARY OF THE INVENTION

Briefly stated, the debris collection apparatus for use during the cleaning of boat hulls that forms the basis of the present invention comprises a debris collection tray for catching debris as it is removed from the hull and a pair of wind screens to block the wind and prevent debris from being blown away from the collection tray. Both the collection tray and the wind screens comprise adjustable tubular frames which suspend a flexible sheet within their periphery utilizing alligator type clips. The tubular frames are attached to the boat hull by either magnetic or suction attachment devices through flexible joint assemblies.

BRIEF DESCRIPTION OF THE SEVERAL VIEWS OF THE DRAWINGS

Other objects, advantages, and novel features of the present invention will become apparent from the following detailed description of the invention when considered in conjunction with the accompanying drawings, wherein.

DETAILED DESCRIPTION OF THE INVENTION

Figure 1:
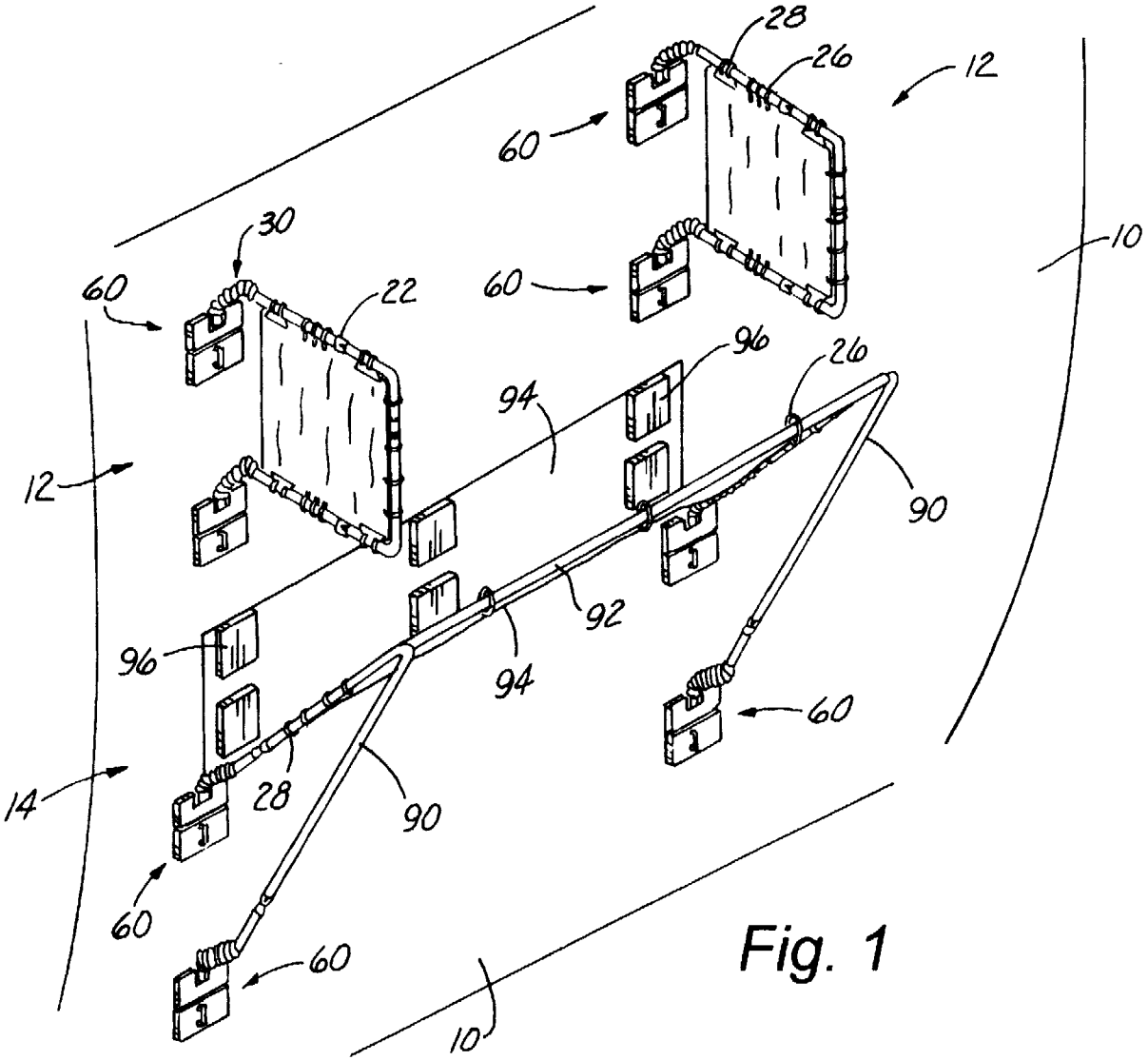
FIG. 1 is a perspective view of the invention secured to the hull of a boat undergoing cleaning.

Referring now to the drawings, wherein like reference numerals designate identical or corresponding parts throughout the several views, FIG. 1 depicts the invention secured to the hull 10 of a boat undergoing cleaning and is seen to comprise a pair of wind screens 12 and a debris collection tray 14. The debris collection tray 14 is secured to the hull 10 below the area to be cleaned so as to catch the debris as it is scraped or otherwise removed. The wind screens 12 are secured to the hull 10 adjacent the area to be cleaned in order to block the wind and prevent the blowing of debris away from the collection tray 14.

Figure 3:
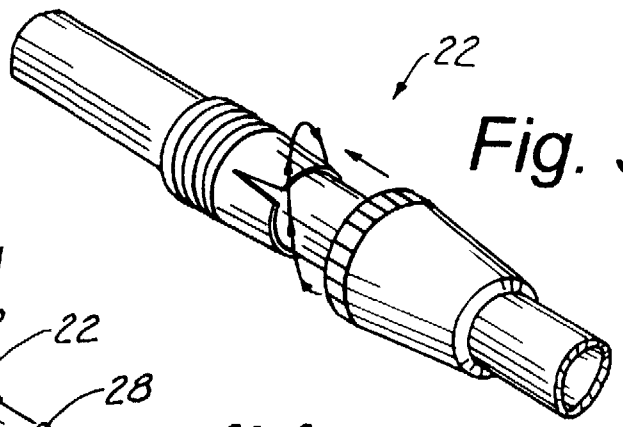
FIG. 3 depicts a frame locking collar of the invention.
Figure 4:
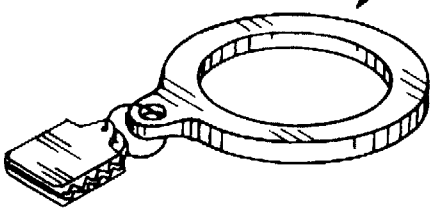
FIG. 4 depicts a ring-clip of the invention.
Figure 2:
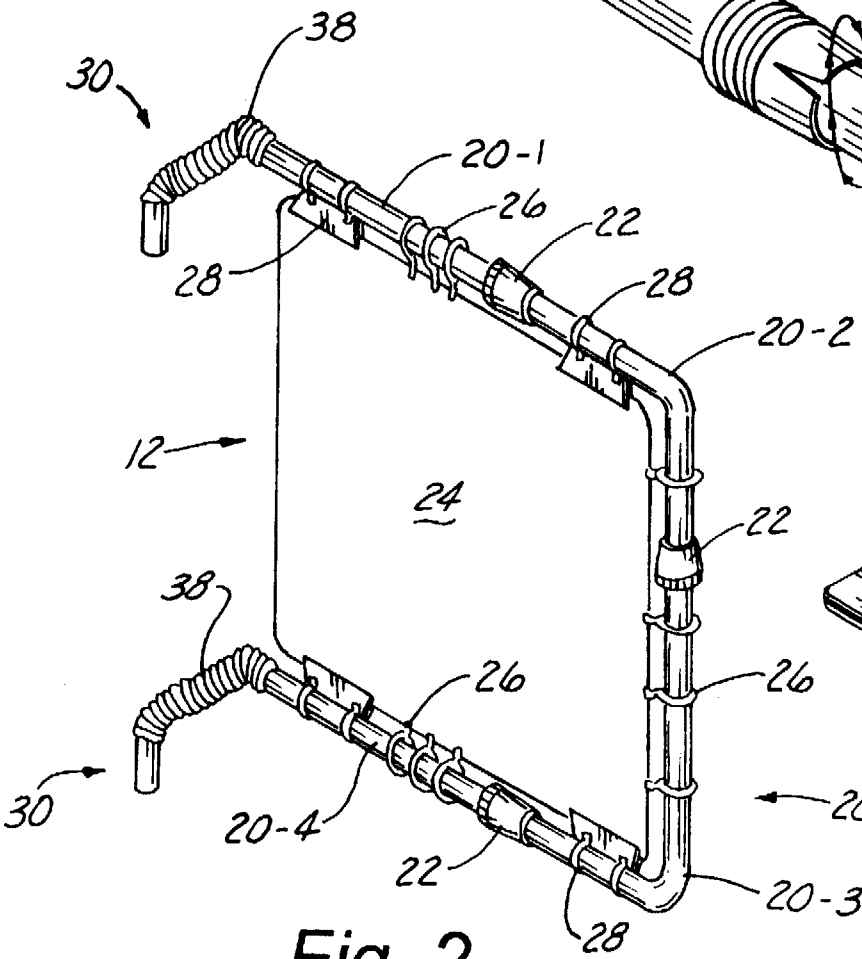
FIG. 2 is a perspective view of a wind screen of the invention.
Figure 5:
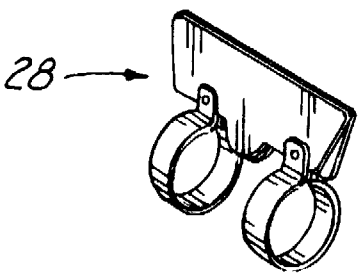
FIG. 5 depicts a ring-clamp of the invention.

Referring now to FIGS. 2 and 3, the wind screens 12 are seen to comprise a three sided tubular frame 20 having four sections 20-1, 20-2, 20-3, 20-4 which are telescopically connected as shown to permit adjustment of the frame from a closed, storage configuration to an expanded, operational configuration. The various sections are locked into place by way of three compression-type locking collars 22 as are well known in the art. The tubular frame 20 supports a sheet of flexible material 24, preferably canvas or other similar durable material, by means of several ring clips 26 (FIG. 4) and ring clamps 28 (FIG. 5). These ring clips 26 and ring clamps 28 slide over the tubular frame sections and include spring-loaded, alligator type fasteners which grip the sheet 24 and support it within the frame 20 to block the wind.

Figure 6:
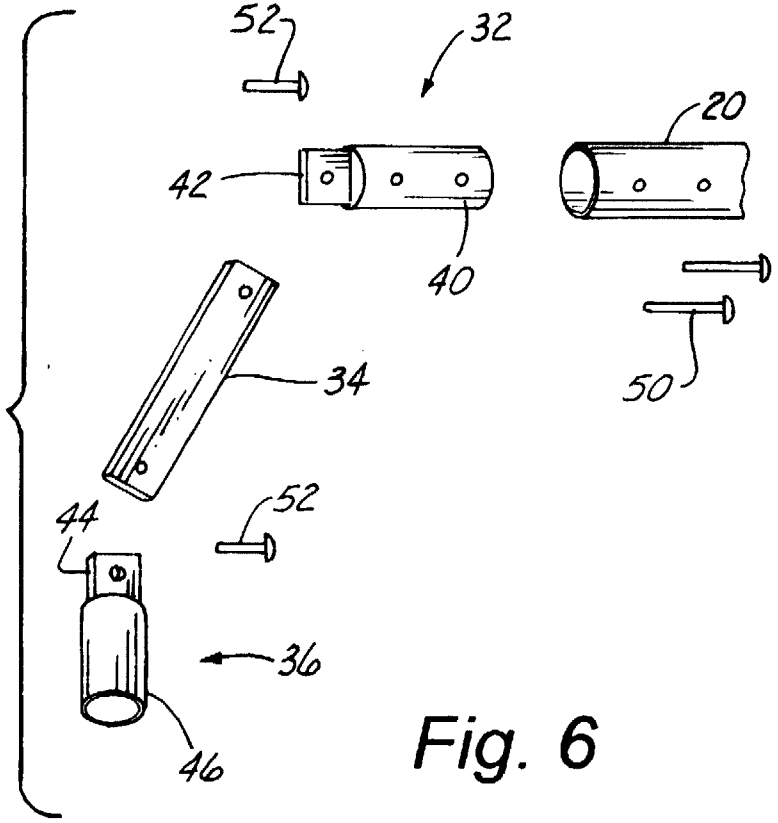
FIG. 6 is an exploded view of a joint assembly of the invention.

Each upper section 20-1 and lower section 20-4 of the wind screen frame 20 includes a joint assembly 30 for connecting the wind screens 12 to the boat hull attachment means to be described below. As seen in the exploded view of FIG. 6, each joint assembly 30 includes a first joint member 32, a link 34, and a second joint member 36, all enclosed within a flexible rubber sleeve 38 (FIG. 2). The first joint member 32 includes a tubular insert section 40 for telescopic receipt within the tubular frame 20 where it is secured by a pair of rivets 50. The opposing end of the first joint member 32 forms a flange 42 for pivotal attachment in a vertical plane to the link 34 with a rivet 52. Similarly, the second joint member 36 includes a flange 44 for pivotal attachment in a vertical plane to the link 34 with a rivet 52. The opposing end of second joint member 36 forms a tubular insert section 46 for insertion into the attachment means of FIGS. 7 and 8.

Figure 7:
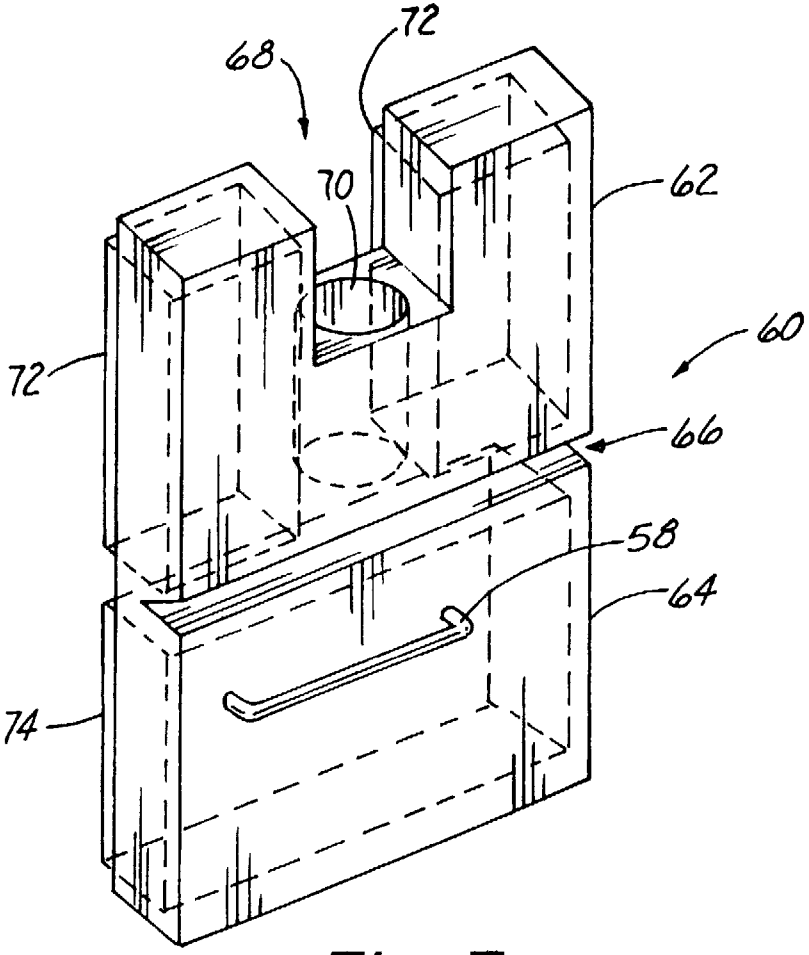
FIG. 7 depicts a magnetic bracket holder of the invention, with the imbedded magnets shown in dashed lines.

Referring now to FIG. 7, a magnetic attachment device 60 for metal boat hulls comprises a block of hard rubber having an upper section 62 and a lower section 64 with a central hinge area 66 to facilitate use of the device on curved hulls. The top surface of the upper section 62 has a cutout 68 with a hole 70 for receipt of the tubular insert section 46 of the joint assemblies 30 previously described. The cutout 68 serves to prevent the joint assemblies 30 from swaying in a horizontal plane. Partially protruding from the rear surface of the hard rubber block of the upper section 62 and lower section 64 are magnets 72, 74 secured within the rubber block by adhesive or during the molding process. The attachment device 60 further includes a handle 58 to aid in removal from the hull and in handling.

Figure 8:
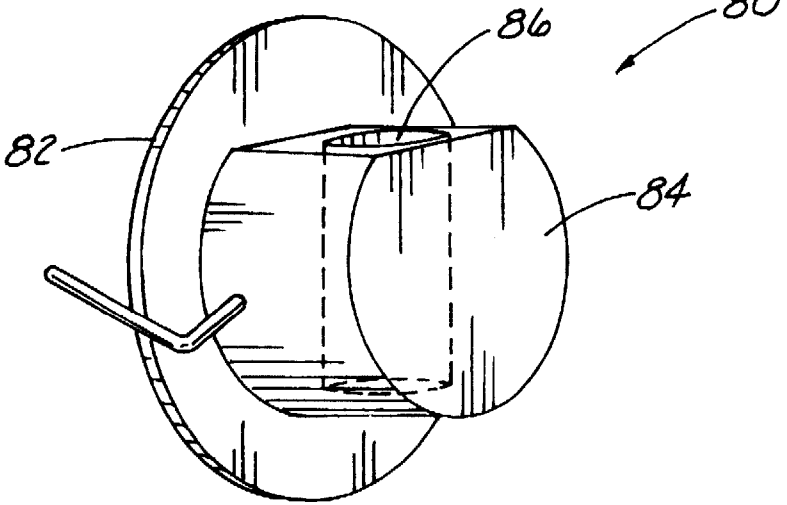
FIG. 8 depicts a suction cup bracket holder of the invention.

A second means for attaching the invention to boat hulls is the suction device 80 depicted in FIG. 8 which utilizes a suction cup 82 rather than the magnets previously described. This embodiment would of course be suitable for non-metallic as well as metallic hulls. Although a standard suction cup may be suitable, the suction device 80 preferably utilizes a mechanically operated suction cup, well known in the art, because of its enhanced attachment capability. A hard rubber block 84 extends from the suction cup 82 and has a central hole 86 for receipt of the tubular insert section 46 of the joint assemblies 30 as previously described.

Referring again to FIG. 1, the collection tray 14 of the invention is seen to include a pair of adjustable, V-shaped vertical end brackets 90 connected by a horizontal cross-member 92. The upper legs of the end brackets 90, in cooperation with the crossmember 92, suspend a flexible sheet of material 94 utilizing the same ring clips 26 and ring clamps 28 as are used with the wind screens 12. The sheet 94 is further supported by a series of hull magnets 96, imbedded within hard rubber similar to the magnetic attachment devices 60, to suspend the sheet 94 in the form of a trough adjacent the hull in order to catch debris as it is removed from the hull. Both the upper and lower legs of the end brackets 90 utilize a joint assembly 30 identical to the joint assembly previously described, as well as either a magnetic attachment device 60 or a suction cup attachment device 80.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A debris collection apparatus for use during the cleaning of boat hulls, comprising:

(a) a debris collection tray comprising a sheet of flexible material suspended along three sides by a tubular support frame wherein said tubular support frame includes first and second V-shaped vertical end brackets connected by a horizontal cross member; and (b) means for temporary attachment of said tray to the boat hull.

2. The apparatus of claim 1 wherein said temporary attachment means includes a plurality of hard rubber blocks each having a magnet imbedded therein.

3. The apparatus of claim 1 wherein said temporary attachment means includes a hard rubber block having a suction cup affixed thereto.

4. The apparatus of claim 1 and further comprising a wind screen and means for temporary attachment of said wind screen to the boat hull.

5. The apparatus of claim 4 wherein said wind screen comprises a sheet of flexible material suspended along three sides by a tubular support frame.

6. The apparatus of claim 5 wherein said tubular support frames further include a pivot joint for securement to said temporary attachment means.

7. A debris collection apparatus for use during the cleaning of boat hulls, comprising:

(a) a debris collection tray comprising a sheet of flexible material suspended along three sides by a tubular support frame;

(b) means for temporary attachment of said tray to the boat hull; and (c) a wind screen and means for temporary attachment of said wind screen to the boat hull wherein said wind screen comprises a sheet of flexible material suspended along three sides by a tubular support frame.

8. The apparatus of claim 7 wherein said temporary attachment means includes a plurality of hard rubber blocks each having a magnet imbedded therein.

9. The apparatus of claim 7 wherein said temporary attachment means includes a hard rubber block having a suction cup affixed thereto.

10. The apparatus of claim 7 wherein said tubular support frame includes first and second V-shaped vertical end brackets connected by a horizontal cross member.

11. The apparatus of claim 7 wherein said tubular support frames further include a pivot joint for securement to said temporary attachment means.

* * * * *